US006421875B1

(12) United States Patent
Coombs et al.

(10) Patent No.: US 6,421,875 B1
(45) Date of Patent: Jul. 23, 2002

(54) VORTEX FLOOR TOOL

(75) Inventors: Richard L. Coombs; Michael J. Shideler, both of Boise, ID (US)

(73) Assignee: Pro-Team, Inc., Boise, ID (US)

( * ) Notice: Subject to any disclaimer, the term of this patent is extended or adjusted under 35 U.S.C. 154(b) by 10 days.

(21) Appl. No.: 09/591,999

(22) Filed: Jun. 12, 2000

(51) Int. Cl.[7] ..... A47L 9/02
(52) U.S. Cl. ..... 15/420; 15/415.1
(58) Field of Search ..... 15/451.1, 420, 15/421

(56) References Cited

U.S. PATENT DOCUMENTS

| | | | | | |
|---|---|---|---|---|---|
| 1,992,238 | A | * | 2/1935 | Rose | 15/420 |
| 2,027,543 | A | * | 1/1936 | Lofgren | 15/420 |
| 3,959,010 | A | | 5/1976 | Thompson et al. | |
| 3,963,515 | A | | 6/1976 | Haldeman et al. | |
| 4,063,570 | A | | 12/1977 | Mitchell et al. | |
| 4,263,693 | A | | 4/1981 | Mekelburg et al. | |
| 4,282,626 | A | | 8/1981 | Schneider | |
| 4,677,705 | A | * | 7/1987 | Schuster | 15/420 X |
| 4,685,170 | A | * | 8/1987 | Ahlf et al. | 15/420 X |
| 5,394,588 | A | | 3/1995 | Kweon et al. | |
| 5,634,238 | A | | 6/1997 | McCaffrey et al. | |
| 5,659,923 | A | * | 8/1997 | Coombs | 15/420 X |
| 5,765,259 | A | | 6/1998 | Cika | |
| 5,987,700 | A | * | 11/1999 | Edlund | 15/420 |

FOREIGN PATENT DOCUMENTS

| | | | | |
|---|---|---|---|---|
| AT | 222082 | * | 7/1962 | 15/420 |
| GB | 29570 | * | 12/1909 | 15/420 |

* cited by examiner

*Primary Examiner*—Chris K. Moore
(74) *Attorney, Agent, or Firm*—Frank J. Dykas; Robert L. Shaver; Stephen M. Nipper

(57) ABSTRACT

A vacuum cleaner floor tool in which offset air intake openings create multiple organized vortices in the vacuum chamber of the floor tool. Air intake openings on the side of the tool produce horizontally oriented vortices and allow the cleaning to be effective along the edge of the tool. A curved or broadened tool edge prevents the tool from being drawn into carpet by vacuum, and allows it to be pushed with little resistance across carpet even though the vacuum within the vacuum chamber is strong enough to produce high air flow through the air intake slots.

20 Claims, 6 Drawing Sheets

VORTEX FLOOR TOOL

BACKGROUND OF THE INVENTION

1. Field of the Invention

The present invention generally relates to vacuum devices, and more particularly to vacuum attachments for cleaning floors.

2. Background Information

When vacuum cleaners are used to clean floors, they use either a powered cleaning head which contacts the floor, or a non-powered cleaning head. The powered cleaning heads typically have a separate electrical motor which powers brushes or rollers which mechanically assist the vacuum process in loosening particulates from carpet fibers. These powered heads are by necessity heavier than non-powered heads. They also have the disadvantage of causing a certain degree of physical damage to carpet fibers when they are utilized. In high volume commercial areas such as in hotels, motels, convention centers, and other carpeted commercial areas, daily vacuuming with a powered vacuum head can shorten the life of carpet by the continual breaking of carpet fibers.

What is needed is a non-powered vacuum head which can be used on carpets or non-carpeted flooring, and which is very effective at picking up particulate matter, especially in carpets.

The problem with most non-powered vacuum heads is that they are much less successful at picking up particulates than powered heads. If suction is increased in non-powered heads, they also have the possibility of being sucked down into the carpet fibers, making movement of the vacuum head over a carpet more difficult. Since there is no agitation of the carpet fibers by rollers or beater bars, a non-powered head has to use some other mechanism in order to pick up particulates as effectively as a powered carpet head.

Prior art carpet heads typically lose a significant amount of efficiency due to the design of the vacuum head. Any time that the air flow is required to take a sharp 90° turn, a significant amount of efficiency is lost. If the cross sectional surface area of the air bypass openings into the vacuum head is too large, then the air speed through each of these openings is decreased. With decreased air speed, there is less capacity of the air to lift and carry particulates, and less ability for the air to disrupt calm layers of air adjacent to the floor surface. If the number of air bypass channels is reduced, and the cross sectional area of each hole is also reduced, air velocities through the air bypass channels can be increased, but it is possible to have areas of carpet which are uncleaned due to the fewer number and smaller size of air bypass channels.

These disadvantages result in prior art floor cleaning tools which are marginally effective in cleaning carpets or non-carpeted floors. One strategy to solve these problems is to design a tool which encourages laminar flow of air through the tool. The belief is that laminar flow is higher in speed, and thus the air has a greater capacity to carry a load of particulates. Some vacuum tools are designed with goal, and promote laminar air flow. However, in practice pure laminar flow is not effective in picking up particulates. The air flow may be faster, but its directness through the tool may keep it from actually picking up any dirt.

Accordingly, it is an object of the invention to provide an improved floor cleaning tool which is aerodynamically designed for increased efficiency. It is a further object of the invention to provide a design which utilizes the configuration and alignment of the air bypass slots to create vortices inside the vacuum head for improved particulate pickup.

It is a further object of the invention to provide a vacuum cleaning tool which has a region in the vacuum head which produces high-speed laminar flow for particulate pickup, another area which provides for vortex formation, and another area which pulls air and particulates from the vortex region and forms them into a laminar flow air pattern.

It is a further object of the invention to provide an aerodynamically configured top cover, which eliminates 90° bends in the air flow. It is a further object of the invention to provide a vacuum tool which has a footprint which provides complete coverage for a section of floor in the path of the vacuum tool.

SUMMARY OF THE INVENTION

These and other objects are attained by the floor tool of the invention, which is designed to generate vortices in the cleaning head. The vortex floor tool is a floor tool for use with a vacuum cleaner. It includes a vacuum chamber in which the vortices are formed, and which includes a front side, a rear side, a right side, and a left side. Each of these sides has a bottom portion having a generally flattened floor contacting bottom edge. The bottom portion is designed to have a rounded leading and trailing edge, and a wide contact zone, for making the tool easy to maneuver on carpet under suction. In the bottom edge, a number of air bypass channels are defined. These air bypass channels are generally perpendicular to the side they reside in. These air bypass channels allow air to enter the vacuum chamber from outside the vacuum chamber, in response to the vacuum created by the vacuum means inside the vacuum chamber. The rear side is parallel to the front side, and is held in a spaced apart relationship with the front side by the right and left side. The front and rear side are attached to the right side as well as to the left side. The right side is held in a spaced relationship with the left side. A top cover portion attaches to the top edges of these four sides. In the top cover portion is defined an orifice for connection to a vacuum means, which is typically a vacuum cleaner. With the four sides, the top cover portion forms the vacuum chamber, which is open on the bottom side. The air bypass channels formed in the front side are offset in alignment from the air bypass channels in the rear side, and are thus configured to form multiple vortices in the vacuum chamber. The four sides make up a generally rectangular vacuum chamber, which could also be somewhat oval, elliptical, or rounded in shape and be equivalent to a rectangular shape.

The left side and the right side can also be configured to define one or more bypass channels in each of the left side and the right side. If present, the air bypass channel in the left side and the right side are configured to induce horizontally oriented vortices inside the vacuum chamber. The vacuum cleaner floor tool has a longitudinal axis which extends normal to the front side and the rear side. The lateral axis is normal to the longitudinal axis and also normal to the left side and the right side. The vertical axis is normal with the longitudinal axis and normal to the lateral axis.

In one configuration of the vacuum cleaner floor tool, the top cover includes a curving front cover face which is connected to the front side and extends vertically from the front wall, and curves towards a horizontal plain in the direction of the rear wall. The curving front cover face connects with an orifice in the top cover for receiving a tube from the vacuum means. This configuration of the device also includes a curve in the rear cover face which is connected to the rear wall and extends generally parallel to the curving front cover face. It begins vertically from the rear wall and curves toward the horizontal plain away from the front side and rear side. The curving rear cover face also connects with the tube receiving orifice, which connects to the vacuum means. The device of this configuration also includes a curving right cover face which is connected to the right side of the top cover, and at its edges, connects to the curving front cover face and the curving rear cover face. The curving right cover face curves towards the longitudinal axis of the floor tool, and towards the horizontal plain. It also forms a connection with a tube receiving orifice for the vacuum means. Also included is a curving left cover face which is connected to the left side of the top cover, and at its edges to the curving front cover face and the curving rear cover face. The curving left cover face curves towards the longitudinal axis of the floor tool and towards the horizontal plain. These four curving sides form a laminar flow top cover which forms an aerodynamically unrestricted path for air from the vacuum chamber to the tube receiving orifice. The curving nature of the laminar flow top cover reduces the velocity loss of the air when it makes the required two 90° turns through the vacuum cleaner floor tool. The vacuum cleaner floor tool of the above curving configuration can be constructed so that the laminar flow top cover portion covers at least ⅔ of the top cover of the vacuum chamber.

Another aspect of the invention includes a vacuum cleaner floor tool in which the offset air bypass channels are configured to create three separate patterns of air flow. The first pattern of air flow is high velocity and laminar, and occurs where the air passes through the air bypass channels from outside the vacuum chamber, and enters into the vacuum chamber itself. Immediately adjacent to the air bypass channels, the air flow changes to a relatively lower speed, and forms into multiple standing vortices inside the vacuum chamber. The offset position of the air bypass channels causes the air streams from each air bypass channel to reinforce the direction of rotation of adjacent vortices, add to its velocity, and augment it. After passing through the high turbulence of the vortices, air once again enters into laminar flow as it passes into the laminar flow top cover portion and into the tube from the vacuum means.

One configuration of the vacuum cleaner flow tool includes a bottom portion on each of the sides of the vacuum chamber. In cross section, this bottom portion can be semicircular or flat in the middle with curved leading edges with a curved leading edge and curved trailing edge. One configuration of the vacuum cleaner floor tool includes air bypass channels which have a cumulative opening area of 0.7 to 0.9 inches in cross section. In one configuration of the vacuum cleaner floor tool, the air bypass channels are spaced greater than 1 inch apart, and less than 2 inches apart. In another configuration of the floor tool, the air bypass channels in the front side are approximately equal in number, and in total cross sectional area, as the air bypass channels in the rear side. In another version of the vacuum cleaner floor tool, the air bypass channels have a cumulative opening area of 0.75 to 0.875 square inches.

The vacuum cleaner floor tool can also include a floor brush which attaches to the vacuum chamber housing and which brushes the floor surface during use.

In the configuration of the vacuum cleaner floor tool which includes one or more air bypass channels in the left and the right sides, the total cross sectional area of the air bypass channels in the right and left sides totals less than 0.2 square inches.

In one configuration of this device, the air bypass channels in the left and the right side are approximately ⅛ inch in height and ⅝ inch in width. In this configuration of the floor tool, the combined cross sectional are of the left and right air bypass channels makes up 7 to 12% of the cumulative cross sectional area of all bypass slots of the floor tool. In this configuration of the floor tool, the air bypass channels in the front side and rear side are ¼ inch in width, and have a semicircular top surface.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive.

DESCRIPTION OF THE PREFERRED EMBODIMENTS

Figure 1:
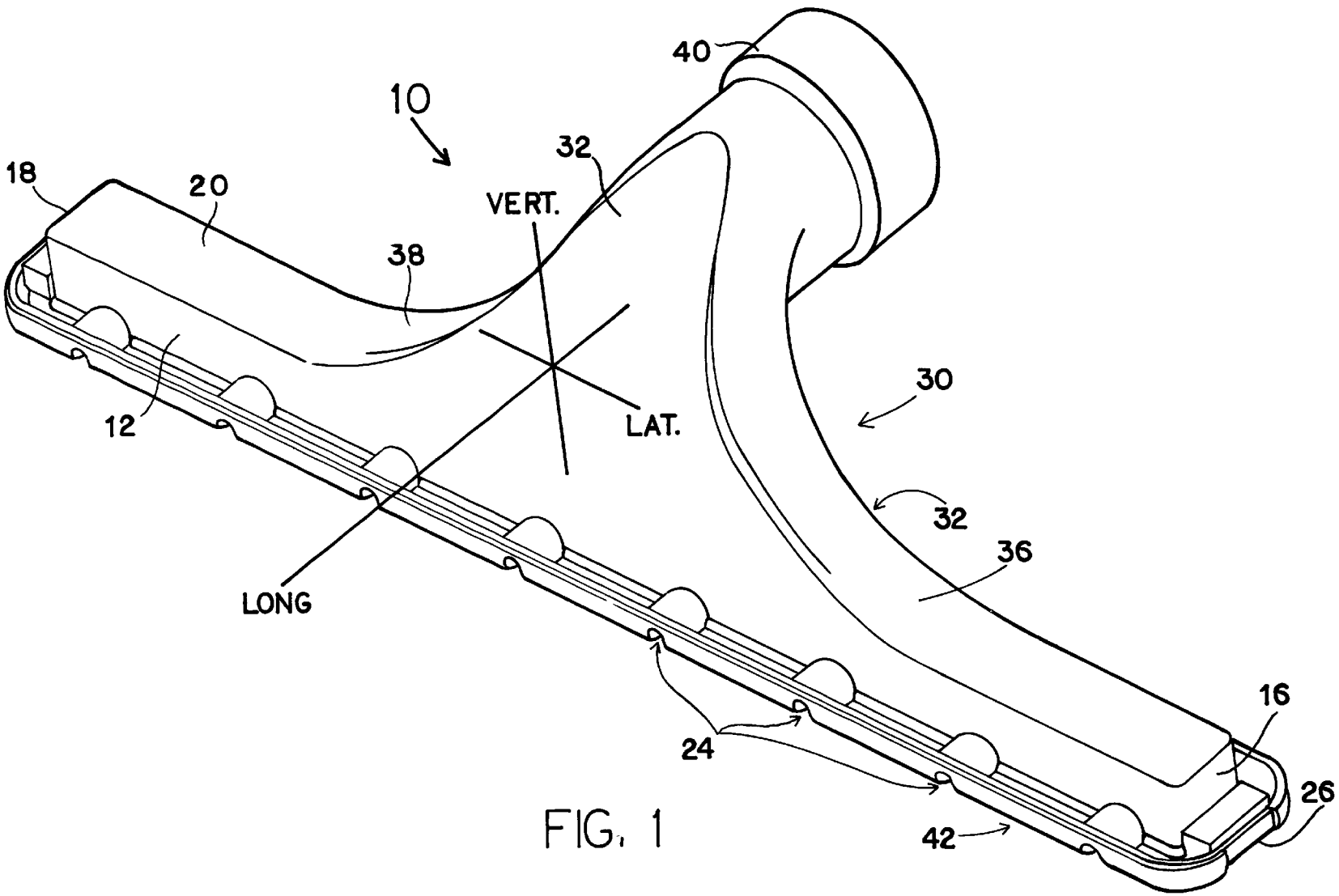
FIG. 1 is a perspective view of the vacuum tool of the invention.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents failing within the spirit and scope of the invention as defined in the claims.

Figure 2:
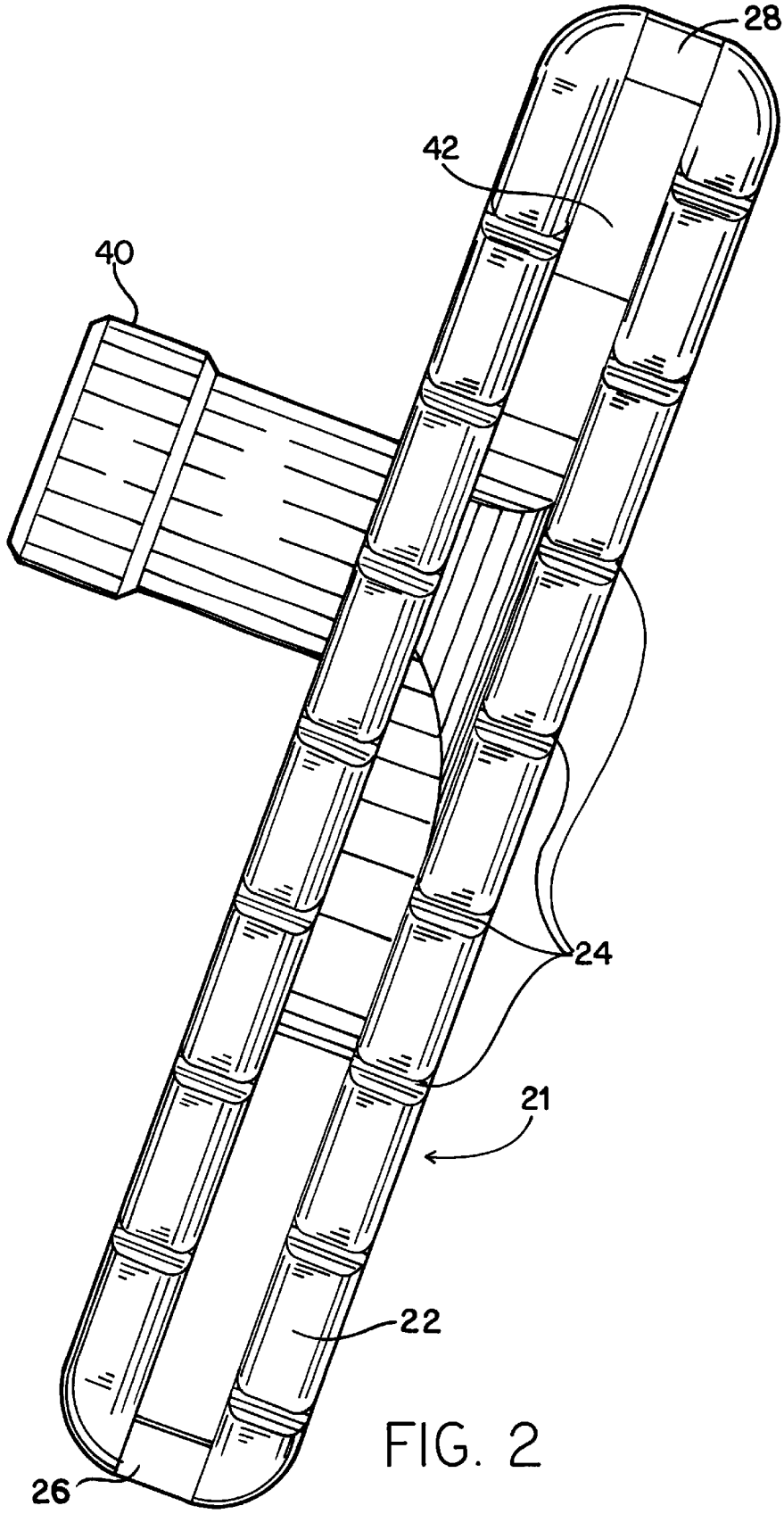
FIG. 2 is a bottom view of the vacuum tool of the invention.
Figure 3:
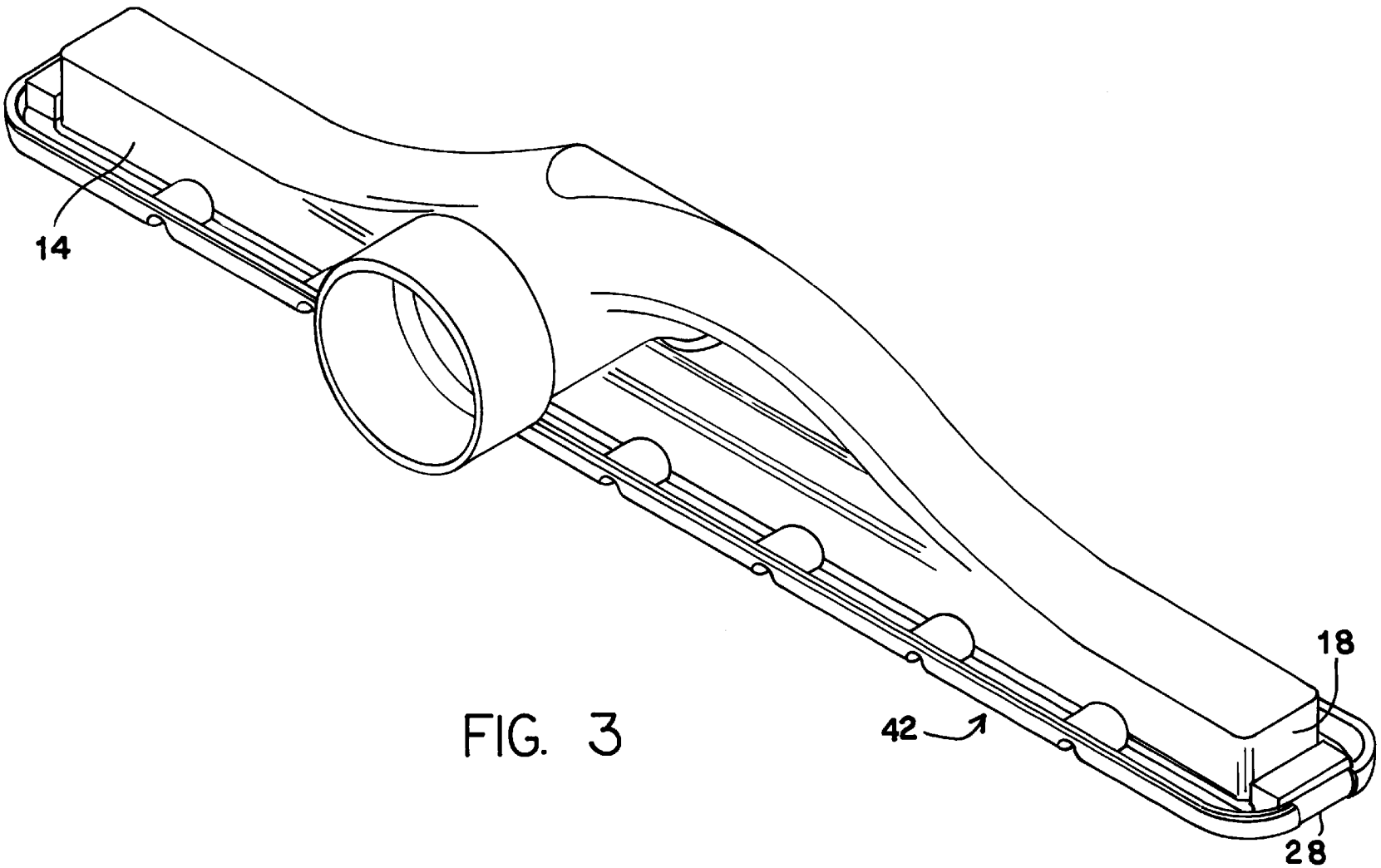
FIG. 3 is a perspective view showing the rear side of the vacuum tool.

One of the preferred embodiments of the invention is shown in the FIGS. 1 through 6. FIG. 1 is a perspective view of the vacuum cleaner floor tool 10 of the invention. This device would be made of a low friction material, such as plastic. Teflon works very well, and has been successful by itself or as part of a ionomer resin. A highly effective material has been found to be Formion® FI 200, made by A. Schulman Inc. The device of the invention includes a front side 12, a rear side 14 (best seen in FIG. 3), a left side 16, a right side 18 (best seen in FIG. 3), and a top cover portion 20. Each of these sides has a flattened floor contacting bottom edge 22, as best seen in FIG. 2. Within the bottom edge 22 are air bypass channels 24. In the preferred embodiment of the invention shown in the drawings, there are eight air bypass channels 24 in the front side 12 and seven air bypass channels in the rear side 14 of the device. The device shown includes a left side air bypass channel 26 and a right air bypass channel 28. The top cover portion 20 includes a laminar flow top cover portion 30 which has a curving front cover face 32, a curving rear cover face 34, a curving left cover face 36, and a curving right cover face 38. The front side 12 is connected at two of its edges to the left side 16 and the right side 18. The rear side 14 is similarly connected to the left side 16 and the right side 18. The top cover portion 20 attaches to the top edges of these four walls. The laminar flow top cover portion 30 attaches to the top cover portion 20. The curving front cover face 32 attaches along its edges to the curving left cover face and the curving right cover face. Similarly, the curving rear cover face 34 attaches to the curving left cover face 36 and the curving right cover face 38 along their edges. These four curving cover faces converge together and form a tube receiving orifice 40. The tube receiving orifice 40 is configured for frictional interfacing with a tube from a vacuum device.

In this configuration of the device, the vacuum cleaner floor tool 10 is approximately 16 inches from right side to left side and approximately 1½ inches from front side to rear side. The vacuum cleaner floor tool 10 has a longitudinal axis, as shown in FIG. 1. It also has a lateral axis, which is perpendicular to the left and the right side and also perpendicular with the longitudinal axis. It also has a vertical axis which is perpendicular to the longitudinal axis and the lateral axis.

In the preferred embodiment of the invention shown in FIGS. 1 through 6, the laminar flow top cover portion 30 forms an aerodynamically unobstructed path for air from the vacuum chamber 42 to the tube receiving orifice 40. In this configuration, the laminar flow top cover portion 30 covers at least ⅔ of the top cover 20 of the vacuum chamber 42. This reduces air velocity loss when air makes the required two 90° turns in going through the floor tool 10.

Figure 5:
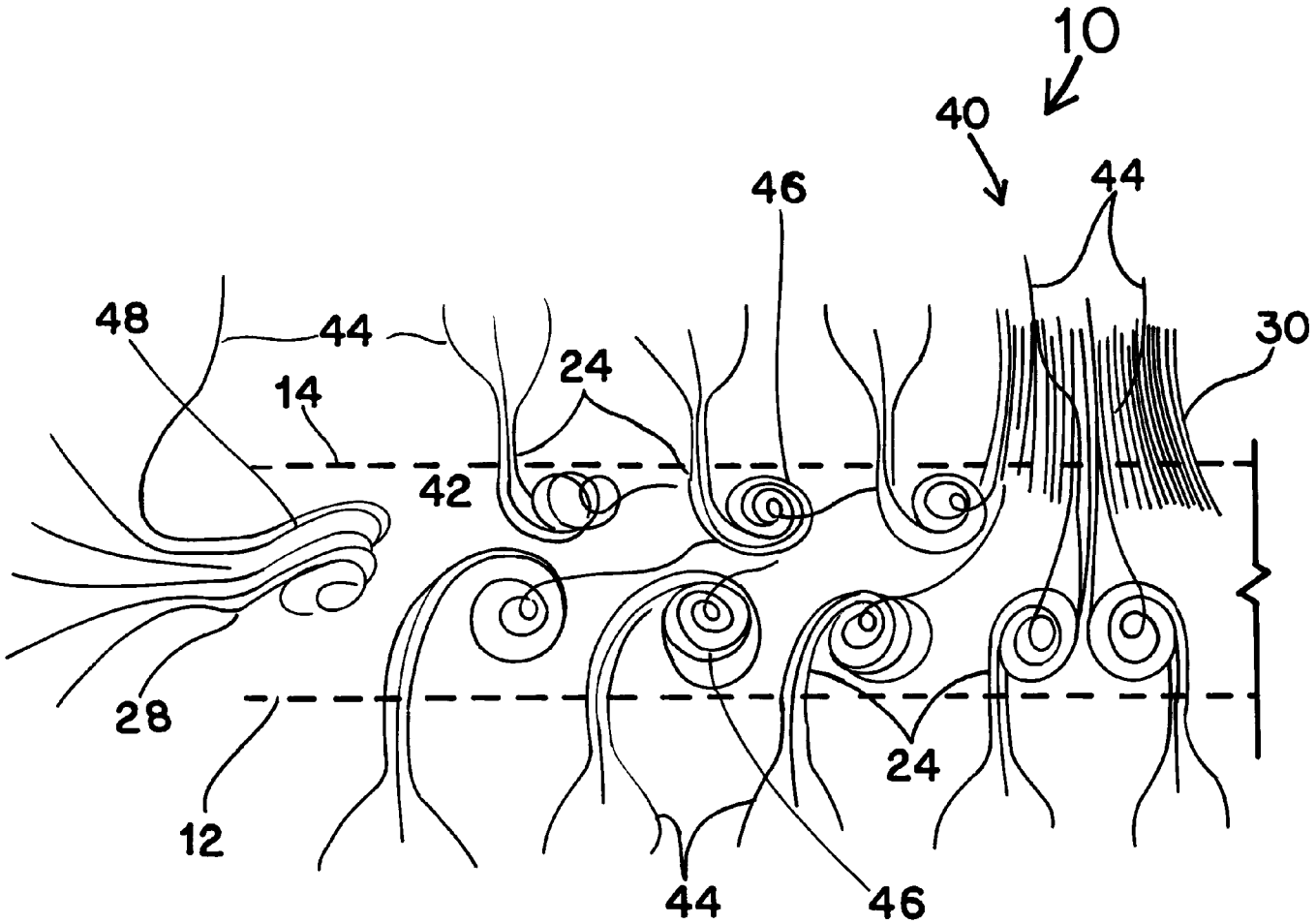
FIG. 5 is a top view showing air flow patterns inside the vacuum tool of the invention.

This configuration of the vacuum cleaner floor tool 10 is configured specifically to create air flow in three stages. In the first stage, air passes through the air bypass channels 24 at a very high speed, super laminar flow. This is best shown in FIG. 5. FIG. 5 shows air pathways 44 as air is drawn from outside the vacuum chamber 42, to inside the vacuum chamber 42. The dotted line in FIG. 5 shows the approximate outline of the vacuum cleaner floor tool 10 where the air pathways 44 converge and pass into the vacuum chamber 44 at the air bypass channels 24. At this point the air accelerates greatly from its speed just outside the air bypass channels 24, and is quite laminar in flow pattern. This speed helps pick up particulates, and disrupts the calm layer of air at the floor surface. The air flow and the passage of the tool provide some mechanical movements to carpet fibers, and any dislodged particles are moved with the air. Immediately after entering the vacuum chamber 42, the air pathways 44 from one air bypass channel interact with the air pathways 44 from adjacent air bypass channels 24, and the specific arrangement of air bypass channels 24, which is shown in FIG. 5, results in the formation of vortices 46. Upon enter the vacuum chamber 42, the air suddenly expands, which is like a small explosion above the carpet fibers. This standing pressure explosion further agitates the carpet fibers, loosening particulates. The alternating configuration of the air bypass channels 24 in the front side 12 compared to the air bypass channels 24 in the rear side 14 results in eight vortices 46 being formed between the air bypass channels 24 of the front side 12, and six vortices 46 being formed between the air bypass channels 24 of the rear side 14. In this particular configuration there are eight bypass channels 24 in the front side 12 and 7 air bypass channels 24 in the rear side 14. Other configurations are of course possible and will result in the vortex creating effects of the invention. A similar tool could be designed which is a 4 inch tool, a 12 inch tool, a 20 inch tool, or other sizes. Each of these would have a different number of air bypass channels, but would operate by creating vortices.

The vortices 46 are the second air flow pattern formed in the vacuum cleaner floor tool 10. The air pathways 44 through the vortices 46 are relatively slower in velocity, and also have lost their laminar flow characteristics. However, the vortices are organized and their standing nature and speed make them effective at dislodging and suspending particles. In the vortices, the air pathways 44 are organized in nature, and not randomly turbulent, and thus maintain a considerable amount of velocity. However, they are organized into tight vortices 46, which have the effect of lifting and carrying particulate matter. In prior art vacuum tools, the air bypass channels are typically arranged directly opposite each other, and the air pathway from one air bypass channel collides with an opposite air pathway, and they cancel each other out and kill the speed of both air flows. The result is randomly turbulent air patterns in the prior art vacuum chamber, until air is drawn into the vacuum tube. The air flow patterns in the tool of the invention are a controlled turbulence, and never lose all their speed, and always aid in picking up particulates.

Figure 4:
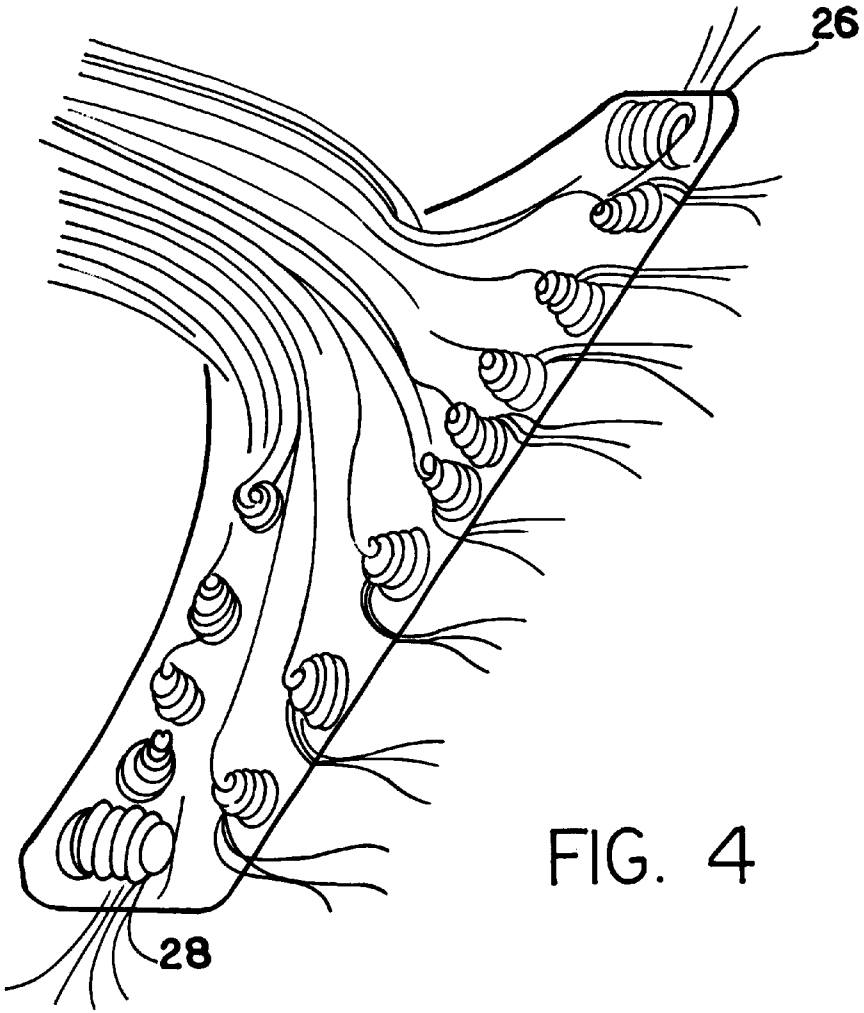
FIG. 4 is a perspective view showing air flow patterns inside the vacuum tool of the invention.

After the vortices 46, the air pathways 44 are drawn into the laminar flow top cover 30, and exit the vacuum cleaner floor tool through the tube receiving orifice 40. This is the third air pattern, and is once again laminar and high speed. FIG. 4 shows a perspective view of this three-stage air pattern, and shows the eight vortices 46 behind the front side 12 and several of the rear vortices 46.

The preferred embodiment also has a left side bypass channel 26 and right side air bypass channel 28. As air pathways 44 are drawn into left side air bypass channel 26 and right side air bypass channel 28, a horizontal vortex 48 is formed inside the vacuum chamber 42 adjacent to the left side air bypass channel 26 and the right side air bypass channel 28. This is because the airflow pathway 44 entering through the side air bypass channels hit the adjacent rising spiral of the first vortices, and is lifted up and curled over from this contact. There is purposely enough space in the vacuum chamber 42 to accommodate these horizontal vortices. It was found that if the vacuum chamber is lowered in the end region to prevent the formation of the horizontal vortices, the air stream from the side bypass channels cancels out the adjacent vortices.

Figure 6:
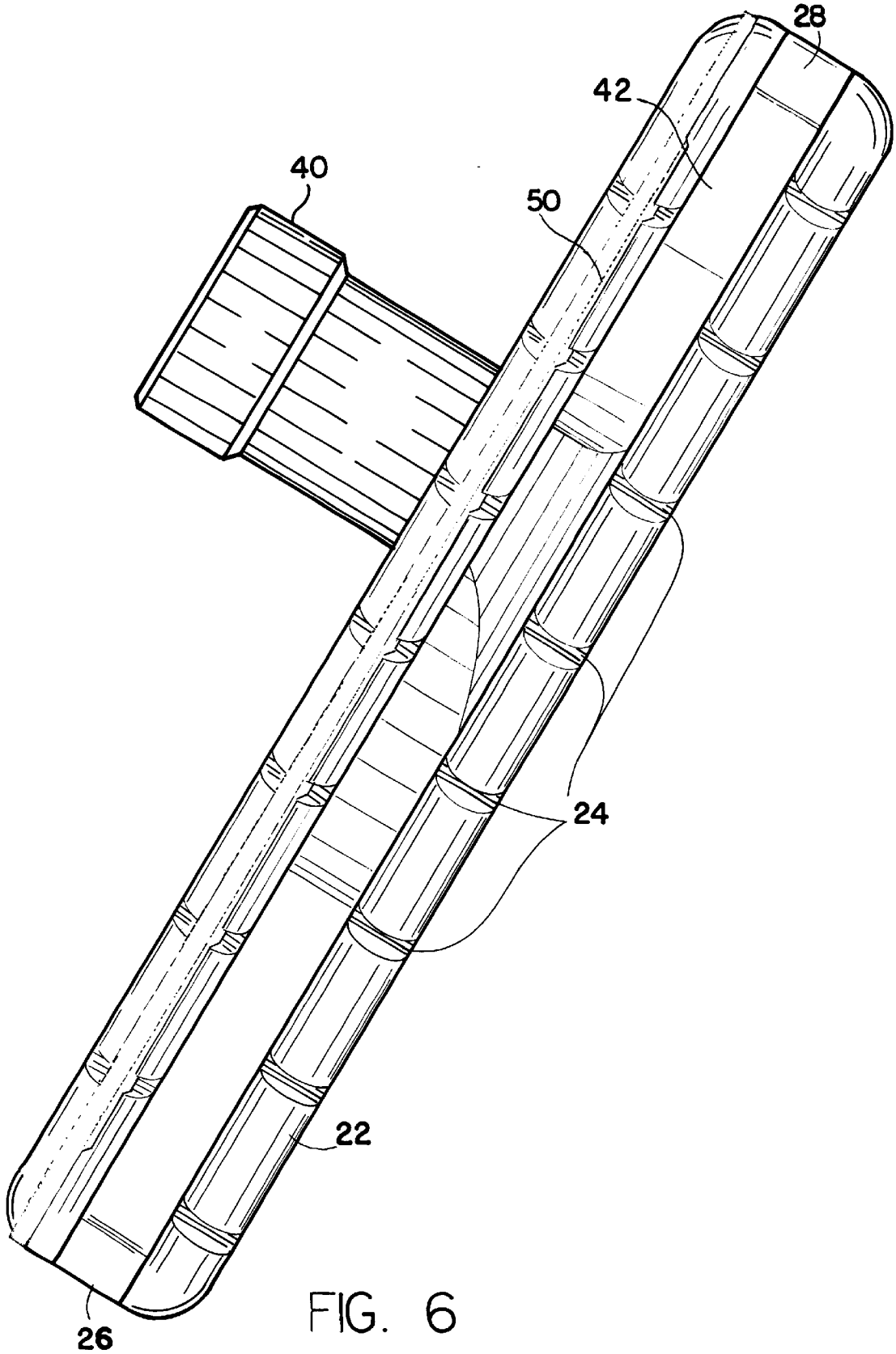
FIG. 6 is a bottom view of the vacuum tool of the invention, with a brush.

As shown in FIG. 2, the vacuum cleaner floor tool 10 includes a bottom portion 21 having a generally flattened floor contacting bottom edge 22. In this configuration, this floor contacting bottom portion is curved in cross section. Other preferred profiles of this edge include a flat inner region, with a curved leading edge, and a curved trailing edge. These shapes are for aiding the floor tool in moving across carpet without being sucked down into the carpet, or otherwise resisting movement. A curved shape has the advantage of having the least surface area on the carpet, but when differential pressure pulls the tool into the carpet, more of the curve comes into contact with the carpet, and resists being pulled into the carpet. A brush 50 can be included in the design, as shown in FIG. 6.

It has been found that controlling the spacing, the number, and the size of the air bypass channels 24, 26, and 28 is critical. The goal of correct spacing and sizing of the channels is to achieve good coverage of the entire floor under the floor tool, and to have high rates of air speed through the air bypass channels 24. It is also desirable to have good air speed through the side air bypass channels 26 and 28. If these side air bypass channels 26 and 28 are too large, then it effects the efficiency of the other air bypass channels 24. What has been found to be the preferred configuration for vacuums which provide approximately 75 cfm to 150 cfm of air flow is a configuration in which all of the air bypass channels have a cumulative cross sectional area of 0.7 to 0.9 square inches. Optimally, the air bypass channels 24 are spaced more than 1 inch apart, and less than 2 inches apart. This spacing is for a 16 inch tool, and would be different for different sizes of tools. The air bypass channels 24 in the front side 12 are approximately equal to the number of air bypass channels 24 in the rear side 14. The preferred embodiment shown in the FIGS. has eight air bypass channels 24 in the front side 12 and seven air bypass channels 24 in the rear side 14. With this configuration, tools of the invention lose less than 3% in air flow through the tool head compared to efficiency losses of 13% to 30% in prior art devices.

Another preferred configuration is a vacuum cleaner floor tool 10 in which the air bypass channels have a cumulative cross sectional opening area of 0.75 to 0.875 inches. An optional configuration is one in which the left side air bypass channels 26 and the right side air bypass channels 28 have a combined cross sectional area of less than 0.1 square inches. In this configuration, a left side air bypass channel 26 and a right side air bypass channel 28 are optimally ⅛ inch in height and ⅝ inches in width. The cumulative cross sectional area of the left and right side air bypass channels 26 and 28 is 7 to 12% of the cumulative cross sectional area of all the air bypass channels 24 of the floor tool. In the preferred configuration shown, the air bypass channels 24 are ⅛ inch in width, approximately ⅛ inch in height, and have a curving top surface. If the air bypass channels are too small in size, they can be blocked when the tool is pulled into the carpet fibers by the differential pressure.

The floor coverage resulting from the configuration of air bypass channels 24 and the resulting vortices 46 and 48 is shown in FIG. 5. When the vacuum cleaner floor tool 10 passes over an area of floor, whether carpeted or uncarpeted, the footprint of the vacuum cleaner floor tool 10 results in all regions of the underlying floor being subjected to the scouring action of high velocity air entering or in the air bypass channels 24, 26, and 28, and/or the additional scouring and lifting action of multiple vortices 46 and 48 in the vacuum chamber 42. The scouring zone from each air bypass channel is wider than the width of the air bypass channel itself, and actually overlaps with the adjacent scouring zone from another air bypass channel. The numerous vortices add scouring action to the scouring zones created by each air bypass channel.

While there is shown and described the present preferred embodiment of the invention, it is to be distinctly understood that this invention is not limited thereto but may be variously embodied to practice within the scope of the following claims.

From the foregoing description, it will be apparent that various changes may be made without departing from the spirit and scope of the invention as defined by the following claims.

We claim:

1. A vacuum cleaner floor tool for use with a vacuum means which comprises:

an elongated, generally rectangular vacuum chamber comprising:

a front side, with a top edge and a bottom portion having a generally flattened floor contacting bottom edge, in which said bottom portion of said front side defines a plurality of front air bypass channels for restricting a flow of air into said vacuum chamber, wherein said channels are generally perpendicular to said front side;

a rear side, with a top edge and a bottom portion having a generally flattened floor contacting bottom edge, mounted in a juxtaposed spaced apart relationship with said front side, in which said bottom portion of said rear side defines a plurality of rear air bypass channels for restricting a flow of air into said vacuum chamber wherein said rear air bypass channels are offset in alignment from said front air bypass channels, wherein said channels are generally perpendicular to said rear side;

a right side, with a top edge and a bottom portion having a generally flattened floor contacting bottom edge, and attached to said front side and said rear side;

a left side, with a top edge and a bottom portion having a generally flattened floor contacting bottom edge, mounted in a juxtaposed spaced apart relationship with said right side, and attached to said front side and said rear side; and a top cover portion which attaches to said top edges of said sides, which defines an orifice for connection to said vacuum means, and which with said sides forms said vacuum chamber;

wherein said vacuum means creates a negative pressure in said vacuum chamber, air passes into said vacuum chamber through said air bypass channels, and said air bypass channels are arranged to form multiple vortices in said vacuum chamber by said offset alignment of said front and rear air bypass channels.

2. The vacuum cleaner floor tool for use with a vacuum means of claim 1 which further comprises at least one left air bypass channel in said left side and at least one right air bypass channel in said right sides, each of which are configured to induce horizontally oriented vortices inside said vacuum chamber, said left air bypass channel oriented generally perpendicular to said left side, said right air bypass channel oriented generally perpendicular to said right side.

3. The vacuum cleaner floor tool of claim 2 in which said left air bypass channel in said left side and said right air bypass channel in said right side have a total channel cross section of less than 0.1 square inches.

4. The vacuum cleaner floor tool of claim 3 which further comprises a single left air bypass channel approximately ⅛ inch in height and ⅝ inch in width, and a single right air bypass channel approximately ⅛ inch in height and ⅝ inch in width.

5. The vacuum cleaner floor tool of claim 3 in which the combined cross sectional size of said left and right air bypass channels comprise 7 to 12% of the cumulative cross sectional surface area of all air bypass slots of said floor tool.

6. The vacuum cleaner floor tool of claim 1 in which said floor tool includes a longitudinal axis extending normal to said front side and said rear side, and a lateral axis normal with said longitudinal axis and normal to said left side and said right side, and a vertical axis normal with said longitudinal axis and normal to said lateral axis, and in which said top cover includes a left side and a right side, in which said top cover portion is configured for laminar flow, and which comprises:

a curving front cover face which is connected to said front side, and extends vertically from said front wall and curves toward a horizontal plane toward said rear wall, and connects with a tube receiving orifice;

a curving rear cover face which is connected to said rear wall, and extends generally parallel to said front cover face, extending vertically from said rear wall and curving toward a horizontal plane away from said rear wall, and which connects with said tube receiving orifice;

a curving right cover face which is connected to said right side of said top cover and to said front cover face and said rear cover face, and which curves toward said longitudinal axis of said floor tool;

a curving left cover face which is connected to said left side of said top cover and to said front cover face and said rear cover face, and which curves toward said longitudinal axis of said floor tool; wherein said laminar flow top cover portion forms an aerodynamically unobstructed path for air from said vacuum chamber to said tube receiving orifice.

7. The vacuum cleaner floor tool of claim 6 in which said laminar flow top cover portion covers at least two thirds of said top cover of said vacuum chamber.

8. The vacuum cleaner floor tool of claim 7 which said offset air bypass channels are configured to create a laminar-to-vortex-to-laminar flow pattern in said vacuum chamber, in which airflow through said air bypass channels is relatively higher speed and laminar, and in which airflow in said vacuum chamber adjacent said bypass channel is changed to relatively lower speed and comprising multiple vortices by reinforcing interaction of airflows through adjacent offset bypass channels, with airflow near and in said laminar flow top cover portion changing to relatively higher speed and laminar airflow, with said bypass channels configured to form multiple vortices in said vacuum chamber.

9. The vacuum cleaner floor tool of claim 1 in which said bottom portion of said sides is curved in cross section.

10. The vacuum cleaner floor tool of claim 9 in which said bottom portion of said sides further comprises a flat inner region and a curved leading edge.

11. The vacuum cleaner floor tool of claim 10 in which said bottom portion of said sides further comprises a curved trailing edge.

12. The vacuum cleaner floor tool of claim 1 in which said air bypass channels have a cumulative opening area of 0.7 to 0.9 square inches.

13. The vacuum cleaner floor tool of claim 1 in which said air bypass channels are spaced more than 1 inch apart, and less than 2 inches apart.

14. The vacuum cleaner floor tool of claim 1 in which said front air bypass channels are approximately equal in number and total cross sectional area as said rear air bypass channels.

15. The vacuum cleaner floor tool of claim 1 in which said air bypass channels have a cumulative opening area of 0.75 to 0.875 square inches.

16. The vacuum cleaner floor tool of claim 1 which further comprises a floor brush which attaches to said vacuum chamber housing and which brushes floor surface during use.

17. The vacuum cleaner floor tool of claim 1 in which said air bypass channels are ¼ inch in width, and have a curving top surface.

18. A vacuum cleaner floor tool for use with a vacuum means which comprises:

an elongated, generally rectangular vacuum chamber comprising:

a front side, with a top edge and a bottom portion having a generally flattened floor contacting bottom edge, in which said bottom portion of said front side defines a plurality of front air bypass channels for restricting a flow of air into said vacuum chamber, wherein said front air bypass channels have a cumulative opening area of 0.7 to 0.9 square inches;

a rear side, with a top edge and a bottom portion having a generally flattened floor contacting bottom edge, mounted in a juxtaposed spaced apart relationship with said front side, in which said bottom portion of said rear side defines a plurality of rear air bypass channels for restricting a flow of air into said vacuum chamber wherein said rear air bypass channels are offset in alignment from said front air bypass channels, wherein said front air bypass channels have a cumulative opening area of 0.7 to 0.9 square inches;

a right side, with a top edge and a bottom portion having a generally flattened floor contacting bottom edge, and attached to said front side and said rear side;

a left side, with a top edge and a bottom portion having a generally flattened floor contacting bottom edge, mounted in a juxtaposed spaced apart relationship with said right side, and attached to said front side and said rear side; and a top cover portion which attaches to said top edges of said sides, which defines an orifice for connection to said vacuum means, and which with said sides forms said vacuum chamber;

wherein said vacuum means creates a negative pressure in said vacuum chamber, air passes into said vacuum chamber through said air bypass channels, and said air bypass channels are arranged to form multiple vortices in said vacuum chamber by said offset alignment of said front and rear air bypass channels.

19. The vacuum cleaner floor tool of claim 18 in which said air bypass channels have a cumulative opening area of 0.75 to 0.875 square inches.

20. A vacuum cleaner floor tool for use with a vacuum means which comprises:

an elongated, generally rectangular vacuum chamber comprising:

a front side, with a top edge and a bottom portion having a generally flattened floor contacting bottom edge, in which said bottom portion of said front side defines a plurality of front air bypass channels for restricting a flow of air into said vacuum chamber, wherein said air bypass channels are spaced more than 1 inch apart, and less than 2 inches apart;

a rear side, with a top edge and a bottom portion having a generally flattened floor contacting bottom edge, mounted in a juxtaposed spaced apart relationship with said front side, in which said bottom portion of said rear side defines a plurality of rear air bypass channels for restricting a flow of air into said vacuum chamber wherein said rear air bypass channels are offset in alignment from said front air bypass channels, wherein said air bypass channels are spaced more than 1 inch apart, and less than 2 inches apart;

a right side, with a top edge and a bottom portion having a generally flattened floor contacting bottom edge, and attached to said front side and said rear side;

a left side, with a top edge and a bottom portion having a generally flattened floor contacting bottom edge, mounted in a juxtaposed spaced apart relationship with said right side, and attached to said front side and said rear side; and a top cover portion which attaches to said top edges of said sides, which defines an orifice for connection to said vacuum means, and which with said sides forms said vacuum chamber; wherein said vacuum means creates a negative pressure in said vacuum chamber, air passes into said vacuum chamber through said air bypass channels, and said air bypass channels are arranged to form multiple vortices in said vacuum chamber by said offset alignment of said front and rear air bypass channels.

* * * * *